US009196197B2

(12) United States Patent
Kim

(10) Patent No.: US 9,196,197 B2
(45) Date of Patent: Nov. 24, 2015

(54) DISPLAY DEVICE AND METHOD FOR DRIVING THE SAME

(71) Applicant: Samsung Display Co., Ltd., Yongin-si, Gyeonggi-do (KR)

(72) Inventor: Ki-Wook Kim, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 52 days.

(21) Appl. No.: 14/226,370

(22) Filed: Mar. 26, 2014

(65) Prior Publication Data

US 2015/0116383 A1 Apr. 30, 2015

(30) Foreign Application Priority Data

Oct. 29, 2013 (KR) ..... 10-2013-0129255

(51) Int. Cl.
*G09G 3/32* (2006.01)

(52) U.S. Cl.
CPC ..... *G09G 3/3258* (2013.01); *G09G 3/3266* (2013.01); *G09G 2300/0809* (2013.01)

(58) Field of Classification Search
None
See application file for complete search history.

(56) References Cited

U.S. PATENT DOCUMENTS

| | | | | |
|---|---|---|---|---|
| 2007/0001938 | A1 | 1/2007 | Lee et al. | |
| 2012/0113077 | A1 | 5/2012 | Kang | |
| 2013/0140663 | A1 * | 6/2013 | Fukuda | 257/432 |
| 2014/0139503 | A1 | 5/2014 | Han | |

FOREIGN PATENT DOCUMENTS

| | | | |
|---|---|---|---|
| KR | 10-2006-0132168 | A | 12/2006 |
| KR | 10-2007-0002148 | A | 1/2007 |
| KR | 10-2011-0068164 | A | 6/2011 |
| KR | 10-2014-0064482 | | 5/2014 |

* cited by examiner

*Primary Examiner* — Gerald Johnson
(74) *Attorney, Agent, or Firm* — Christie, Parker & Hale, LLP

(57) ABSTRACT

A display device includes a first sub-pixel and a second sub-pixel configured to share one data line, a first transistor configured to turn on or off by a first control signal and configured to couple the first sub-pixel to the one data line, and a second transistor configured to turn on or off alternately with the first transistor by a second control signal having a phase difference from that of the first control signal and configured to couple the second sub-pixel to the one data line.

16 Claims, 7 Drawing Sheets

DISPLAY DEVICE AND METHOD FOR DRIVING THE SAME

CROSS-REFERENCE TO RELATED APPLICATION

This application claims priority to and the benefit of Korean Patent Application No. 10-2013-0129255, filed on Oct. 29, 2013, with the Korean intellectual Property Office, the entire disclosure of which is incorporated herein by reference.

BACKGROUND

1. Field

Embodiments of the present invention relate to a display device and a method for driving the same.

2. Description of the Related Art in general, a display device includes a plurality of pixels provided in an area defined by a black matrix or a pixel defining layer. Examples of the display device include liquid crystal display (LCD), plasma display panel (PDP), organic light emitting display (OLED), and the like.

As a method of driving the display device, there is a sequential driving method, in which a data signal is received according to a scan signal sequentially applied to the plurality of pixels, and the pixels emit light in the order of receiving the data signal. Another method of driving the display device is a concurrent (e.g., simultaneous) driving method, in which a data signal of one frame is received, and all of the pixels emit light at the same time.

Meanwhile, the display device has a data driver configured to apply a data signal to each of the plurality of pixels. However, as the size of a display panel becomes larger and the resolution of the display panel becomes higher, the number of pixels increase. Accordingly, the number of data lines for applying data signals to the pixels increase, and the number of a data driver integrated circuits increase in proportion thereto.

SUMMARY

Aspects of embodiments of the present invention are directed to a display device capable of reducing the number of data driver integrated circuits and performs a concurrent (e.g., simultaneous) emission with active voltage, and to a driving method thereof. Here, the display device may have a large size and high resolution display panel.

According to an embodiment of the present invention, a display device includes a first sub-pixel and a second sub-pixel configured to share one data line, a first transistor configured to turn on or off by a first control signal and configured to couple (e.g., connect) the first sub-pixel to the one data line, and a second transistor configured to turn on or off alternately with the first transistor by a second control signal having a phase difference from the first control signal and configured to couple the second sub-pixel to the one data line.

The first control signal and the second control signal may be each configured to have a high level and a low level, respectively, during one frame period.

The first control signal may be configured to have a 180 degree phase difference from the second control signal.

The first sub-pixel may be configured to receive a data signal supplied from the one data line when the first transistor is turned on, and the second sub-pixel may be configured to receive a data signal supplied from the one data line when the second transistor is turned on.

The first sub-pixel and the second sub-pixel may be configured to emit light concurrently with luminance according (e.g., responding) to a data signal of an N−1th frame when the first sub-pixel and the second sub-pixel are supplied with a data signal according to an Nth frame.

The first sub-pixel may be configured to emit light with luminance according (e.g., responding) to a data signal of an Nth frame, and the second sub-pixel may be configured to emit light with luminance according (e.g., responding) to a data signal of an N−1th frame, when a data signal according to an Nth frame is applied to either the first sub-pixel or the second sub-pixel.

According to one embodiment of the present invention, the first sub-pixel and the second sub-pixel each include an organic light emitting diode, a driving transistor including a first electrode coupled (e.g., connected) to a first power source ELVDD and a second electrode coupled to the organic light emitting diode, a first operation control transistor coupled to a gate electrode of the driving transistor at a first node and the second electrode of the driving transistor, a second operation control transistor coupled to the first electrode of the driving transistor and a second node, a storage capacitor coupled between the first node and the second node, a third operation control transistor coupled between the second node and a third node, a hold capacitor coupled between a reference voltage and the third node, and a switching transistor, wherein the switching transistor of the first sub-pixel is coupled between the third node of the first sub-pixel and the first transistor, and the switching transistor of the second sub-pixel is coupled between the third node of the second sub-pixel and the second transistor.

According one embodiment of the present invention, the hold capacitor is configured to reset a data of a previous frame stored in the hold capacitor when the first transistor, the second transistor, and the switching transistor are turned on.

According to another embodiment of the present invention, the first sub-pixel includes an organic light emitting diode, a driving transistor including a first electrode coupled (e.g., connected) to a first power source ELVDD and a second electrode coupled to the organic light emitting diode, a threshold voltage compensation capacitor coupled to a gate electrode of the driving transistor, a switching transistor coupled between the threshold voltage compensation capacitor and the first transistor, a storage capacitor coupled between the gate electrode of the driving transistor and the first electrode of the driving transistor, and a first operation control transistor coupled between the gate electrode of the driving transistor and the second electrode of the driving transistor.

According to one embodiment of the present invention, the storage capacitor may be configured to reset a data of a previous frame stored in the storage capacitor when the first transistor and the switching transistor are turned on.

According to one embodiment of the present invention, the second sub-pixel includes an organic light emitting diode, a driving transistor including a first electrode coupled (e.g., connected) to a first power source ELVDD and a second electrode coupled to the organic light emitting diode, a first operation control transistor coupled to a gate electrode of the driving transistor at a first node and the second electrode of the driving transistor, a second operation control transistor coupled to the first electrode of the driving transistor and a second node, a storage capacitor coupled between the first node and the second node, a third operation control transistor coupled between the second node and a third node, a hold capacitor coupled between a reference voltage and the third node, and a switching transistor coupled between the third node and the second transistor.

According to one embodiment of the present invention, the hold capacitor is configured to reset a data of a previous frame stored in the hold capacitor when the second transistor and the switching transistor are turned on.

According to an embodiment of the present invention, a driving method of a display device including a first sub-pixel and a second sub-pixel configured to share one data line, a first transistor and a second transistor configured to couple the one data line to the first sub-pixel and the second sub-pixel, respectively, the method includes applying a first control signal to turn on the first transistor, first scanning, wherein a data signal is applied to the first sub-pixel through the turned on first transistor, and the applied data signal is stored in the first sub-pixel, applying a second control signal to turn on the second transistor, second scanning, wherein a data signal is applied to the second sub-pixel through the turned on second transistor, and the applied data signal is stored in the second sub-pixel, and emitting light from the first sub-pixel and the second sub-pixel, wherein the emitting light from the first sub-pixel and the second sub-pixel has a temporal overlap with the first scanning and the second scanning.

The first sub-pixel and the second sub-pixel may emit light concurrently (e.g., simultaneously) with luminance according (e.g., responding) to a data signal of an N−1th frame, when a data signal according to an Nth frame is applied to the first sub-pixel and the second sub-pixel.

According to another embodiment of the present invention, a driving method of a display device including a first sub-pixel and a second sub-pixel configured to share one data line, and a first transistor and a second transistor configured to couple (e.g., connect) the one data line to the first sub-pixel and the second sub-pixel, respectively, the method includes applying a first control signal to turn on the first transistor, first scanning, wherein a data signal is applied to the first sub-pixel through the turned on first transistor, and the applied data signal is stored in the first sub-pixel, applying a second control signal to turn on the second transistor, second scanning, wherein a data signal is applied to the second sub-pixel through the turned on second transistor, and the applied data signal is stored in the second sub-pixel, and emitting light from the first sub-pixel and the second sub-pixel, wherein the emitting light from the first sub-pixel and the second sub-pixel has a temporal overlap with any one selected from the first scanning or the second scanning.

The first sub-pixel may emit light with luminance according (e.g., responding) to a data signal of an Nth frame, and the second sub-pixel may emit light with luminance according (e.g., responding) to a data signal of an N−1th frame, when a data signal of an Nth frame is applied to any one of the first sub-pixel and the second sub-pixel.

According to embodiments of the present invention, the display device may reduce the number of data lines and the number of data driver integrated circuits by half. Further, such reduction in the number of data lines may also result in decreasing driving loads of a scan driver and decreasing defects caused in process.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The above and other features and aspects of embodiments of the present invention will be more clearly understood from the following detailed description taken in conjunction with the accompanying drawings, in which.

DETAILED DESCRIPTION

Figure 1:
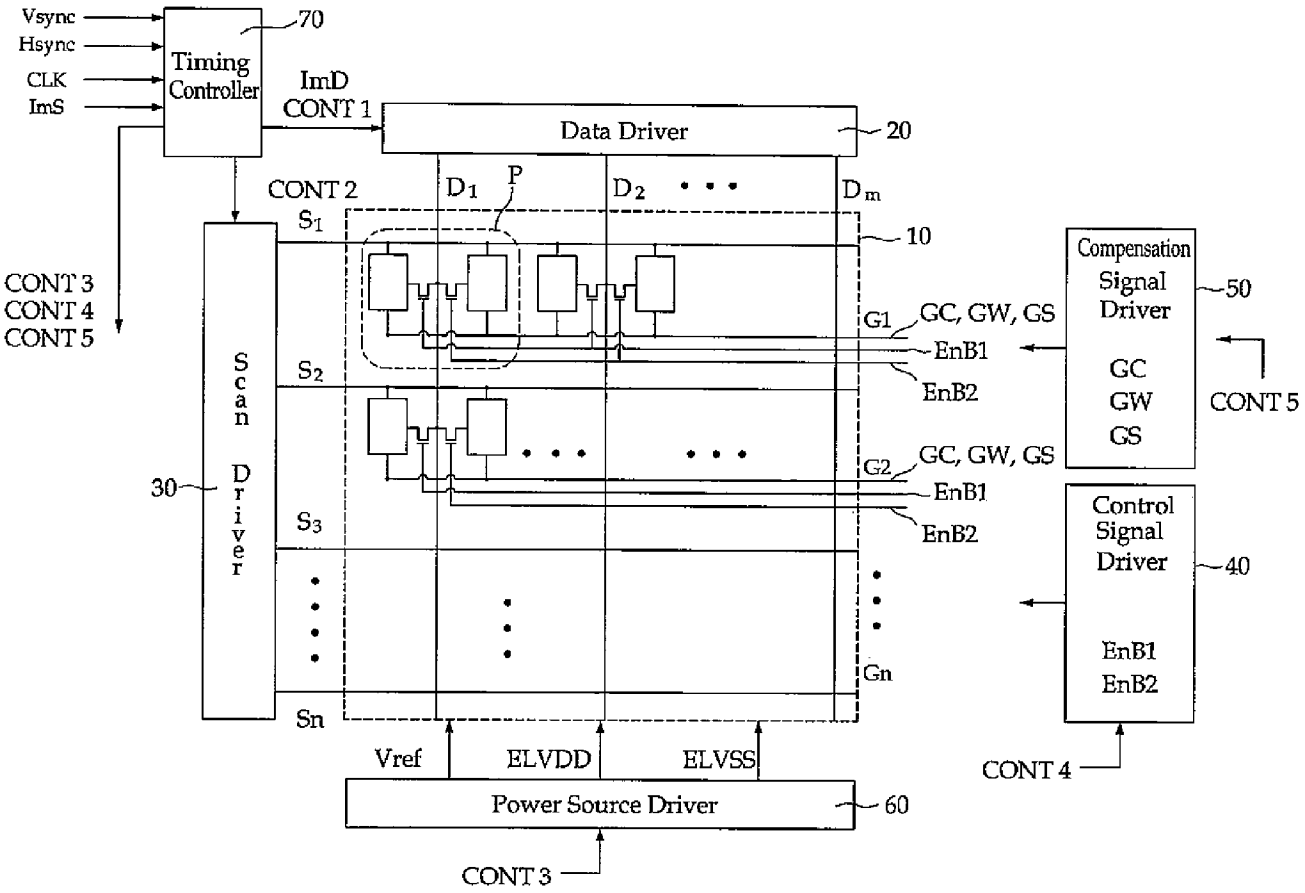
FIG. 1 is a diagram of a display device according to an embodiment of the present invention.

Example embodiments of the present invention will be made clear from the below description with reference to the accompanying drawings. Embodiments of the present invention may, however, be embodied in many different forms and should not be construed as being limited to the embodiments set forth herein. Rather, these embodiments are provided so that this disclosure will be thorough and complete, and will fully convey aspects of the present invention to those skilled in the art. In addition, elements, operations, and techniques that are not related to embodiments of the present invention have been omitted for clear description. Like reference numerals refer to like elements throughout the specification.

The spatially relative terms "below", "beneath", "lower", "above", "upper", and the like, may be used herein for ease of description to describe the relationship between one element or component and another element or component as illustrated in the drawings. It will be understood that the spatially relative terms are intended to encompass different orientations of the device in use or in operation, in addition to the orientation depicted in the drawings. For example, in the case where a device shown in the drawings is turned over, the device positioned "below" or "beneath" another device may be placed "above" another device. Accordingly, the illustrative term "below" may include both the lower and upper positions. The device may also be oriented in another direction, and thus the spatially relative terms may be interpreted differently depending on the orientations of the device.

The terminology used herein is for the purpose of describing example embodiments only and should not be construed as limiting the present invention. As used herein, the singular forms "a," "an" and "the" are intended to include the plural forms as well, unless the context clearly indicates otherwise. It will be further understood that the terms "comprises" and/or "comprising," when used in this specification, specify the presence of mentioned component, step, operation and/or element, but should not be interpreted to exclude the presence or addition of one or More other components, steps, operations and/or elements.

Unless otherwise defined, all terms used herein (including technical and scientific terms) have the same meaning as commonly understood by those skilled in the art to which the present invention pertains. It will be further understood that terms, such as those defined in commonly used dictionaries, should be interpreted as having a meaning that is consistent with their meaning in the context of the relevant art, and should not be interpreted in an ideal or excessively formal sense, unless clearly defined in the present description.

According to an embodiment of the present invention, a display device is operated by a concurrent or simultaneous light emitting method. The concurrent or simultaneous light emitting method refers to a method in which all pixels emit light during a frame period concurrently or simultaneously, so that an image of one frame is displayed on the display device at the same time.

To emit light from all pixels during the light emitting period concurrently or simultaneously, data writing may be completed for all pixels before the light emitting period. A scan period is a period when data is programmed to all the pixels. If one frame period is divided into a scan period and a light emitting period, the scan period may be less than one half of one frame period and the light emitting period may be less than one half of one frame period.

The number of frames refer to the number of images displayed on a display panel per second. Image data used for each frame may be delayed by a shift register, and the image data may be input into a timing controller or a data driver. Therefore, image data input into the timing controller and image data input into the data driver may be different from one another in each frame. In embodiments of the present invention, a frame is defined based on image data input into all pixels of a display panel within a set or predetermined time.

FIG. 1 is a diagram of a display device according to an embodiment of the present invention.

Referring to FIG. 1, a display device may include a display panel 10 including a plurality of pixel circuits P. Each of the pixel circuits P may be composed of a pair of sub-pixels sharing one data line $D_m$. A data driver 20 may be configured to supply a data signal to the pixel circuits P through a plurality of data lines $D_1$-$D_m$. A scan driver 30 may be configured to supply a scan signal to the pixel circuits P through a plurality of scan lines $S_1$~$S_n$. A control signal driver 40 may be configured to supply a first control signal EnB1 and to supply a second control signal EnB2 to the pair of sub-pixels, respectively, through a plurality of control lines $G_1$~$G_n$.

Further, the display device may include a compensation signal driver 50 configured to supply a plurality of compensation signals GC, GW, and GS to the pixel circuits P. A power source driver 60 may be configured to supply a first power source ELVDD, supply a second power source ELVSS, and supply a reference voltage Vref to the pixel circuits P. A timing controller 70 may be configured to supply timing signals to the data driver 20, the scan driver 30, the control signal driver 40, the compensation signal driver 50, and the power source driver 60.

The timing controller 70 may generate first to fifth driving signals (e.g., CONT1 to CONT5) and may generate an image data signal ImD according to an input image signal ImS, a vertical synchronization signal Vsync, a horizontal synchronization signal Hsync, and a main clock signal CLK. The timing controller 70 may separate an Image signal ImS on a frame basis according to the vertical synchronization signal Vsync, and may separate an image signal ImS on a scan line basis according to the horizontal synchronization signal Hsync. The timing controller 70 may transmit the generated image data signal ImD and first driving signal CONT1 to the data driver 20.

Figure 2:
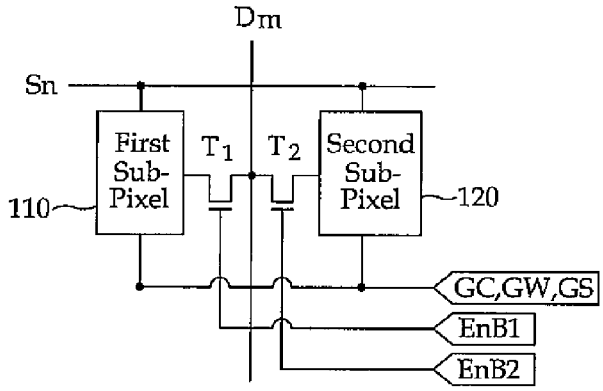
FIG. 2 is a diagram of a pixel circuit according to an embodiment of the present invention.

FIG. 2 is a diagram of a pixel circuit P according to an embodiment of the present invention.

The pixel circuit P may include a first sub-pixel 110 and a second sub-pixel 120, which may be configured to share one data line $D_m$. The pixel circuit P may further include a first transistor T1 configured to couple (e.g., connect) the first sub-pixel 110 to the data line $D_m$, and a second transistor T2 configured to couple the second sub-pixel 120 to the data line $D_m$.

A first control signal EnB1 may be applied to the first transistor T1, and a second control signal EnB2 may be applied to the second transistor T2. The first control signal EnB1 and the second control signal EnB2 may each have a high level value and a low level value within one frame period, and the second control signal EnB2 and the first control signal EnB1 may have a phase difference of 180 degrees. In other words, when the first control signal EnB1 has a high level value, the second control signal EnB2 may have a low level value, and when the first control signal EnB1 has a low level value, the second control signal EnB2 may have a high level value.

The first transistor T1 may be turned on or off by the first control signal EnB1. The second transistor T2 may be turned on or off by the second control signal EnB2. Accordingly, in an embodiment of the present invention, when the first transistor T1 is turned on, the second transistor T2 is turned off, and when the second transistor T2 is turned on, the first transistor T1 is turned off.

When the first transistor T1 is turned on, a data signal is applied to the first sub-pixel 110 via the data line $D_m$. Similarly, when the second transistor T2 is turned on, a data signal is applied to the second sub-pixel 120 via the data line $D_m$.

The circuit structure of the first sub-pixel 110 and the second sub-pixel 120 may be driven to emit light by utilizing the concurrent or simultaneous light emitting method. In an embodiment where the first sub-pixel 110 and the second sub-pixel 120 are operated by a concurrent or simultaneous light emitting method, a plurality of compensation signals GC, GW, and GS may be applied to the first sub-pixel 110 and to the second sub-pixel 120, in order to drive the same.

Figure 3:
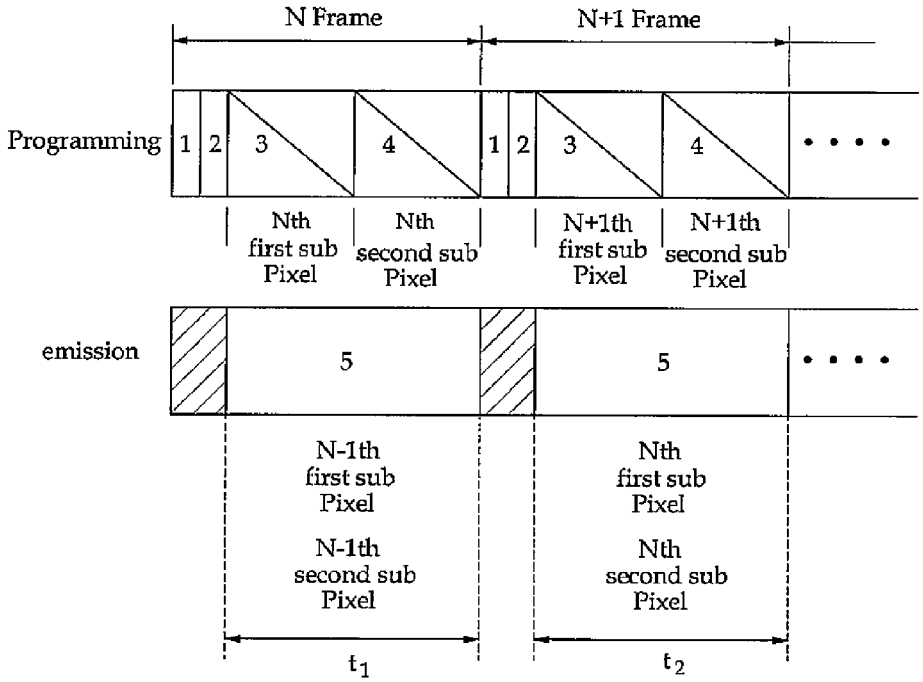
FIG. 3 is a diagram of a driving method of a pixel circuit according to an embodiment of the present invention.

FIG. 3 is a diagram of a driving method of a pixel circuit according to an embodiment of the present invention.

Referring to FIG. 3, one frame period includes a reset and initialization period 1, a compensation and data transmission period 2, a data programming period 3 of the first sub-pixel 110, a data programming period 4 of the second sub-pixel 120, and a concurrent (e.g., simultaneous) light emitting period 5 of the first sub-pixel 110 and the second sub-pixel 120. The data programming period 3 of the first sub-pixel 110 and the data programming period 4 of the second sub-pixel 120 may have a temporal overlap with the concurrent light emitting period 5 of the first sub-pixel 110 and the second sub-pixel 120.

In detail, during an Nth frame, the first sub-pixel 110 and the second sub-pixel 120 emits light concurrently (e.g., simultaneously) according to data programmed during the data programming period 3 of the first sub-pixel 110 during the N−1th frame, and data programmed during the data programming period 4 of the second sub-pixel 120 during the N−1th frame. Further, during an N+1th frame, the first sub-pixel 110 and the second sub-pixel 120 emits light concurrently according to data programmed during the data programming period 3 of the first sub-pixel 110 during the Nth frame, and data programmed during the data programming period 4 of the second sub-pixel 120 during the Nth frame.

For example, a period $t_1$ includes the data programming period 3 of the first sub-pixel 110 during the Nth frame, the data programming period 4 of the second sub-pixel 120 during the Nth frame, and the concurrent light emitting period 5 of the first sub-pixel 110 and the second sub-pixel 120, during which light is emitted according to the data programmed during the data programming period 3 of the first sub-pixel 110 and the data programming period 4 of the second sub-pixel 120 during the N−1th frame.

A period $t_2$ includes the data programming period 3 of the first sub-pixel 110 during the N+1th frame, the data programming period 4 of the second sub-pixel 120 during the N+1th frame, and the concurrent light emitting period 5 of the first sub-pixel 110 and the second sub-pixel 120, during which light is emitted according to the data programmed during the data programming period 3 of the first sub-pixel 110 and the data programming period 4 of the second sub-pixel 120 during the Nth frame.

Figure 4:
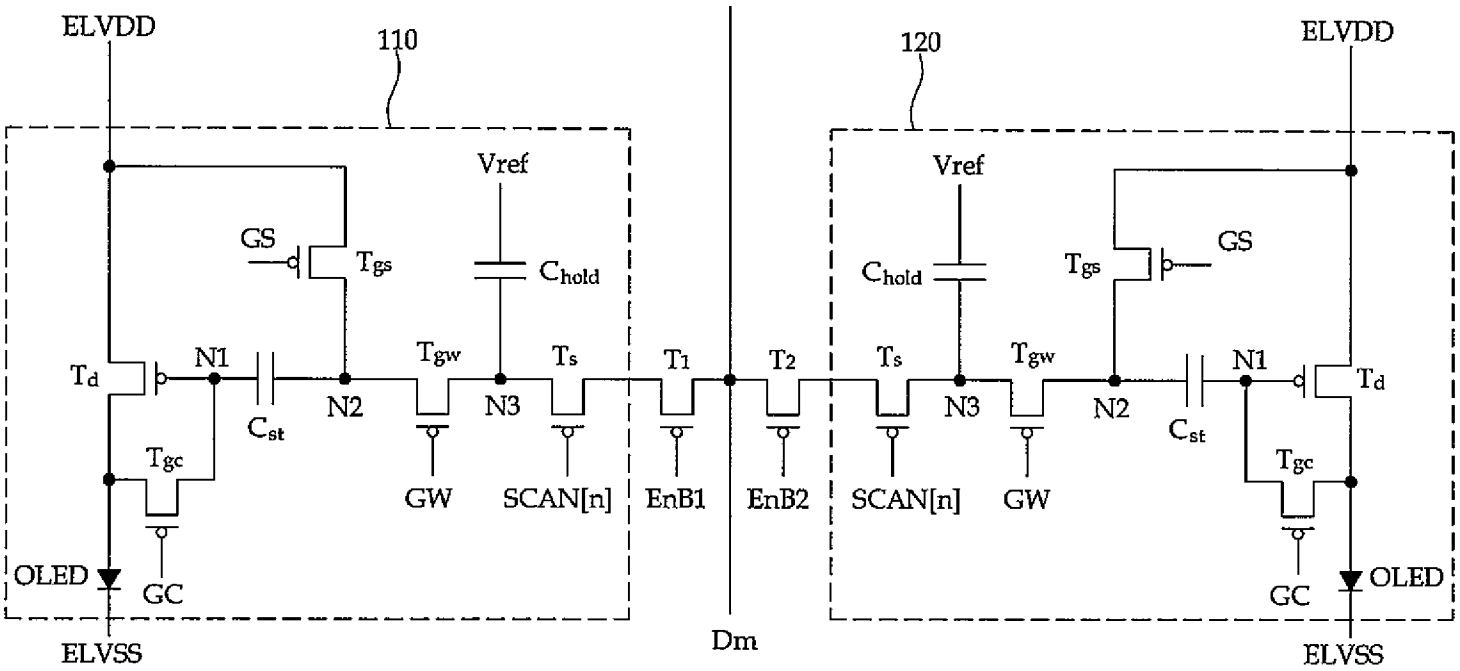
FIG. 4 is a diagram of a pixel circuit that may be driven according to the driving method of FIG. 3.

FIG. 4 is a diagram of a pixel circuit that may be driven according to the driving method of FIG. 3.

Referring to FIG. 4, the pixel circuit includes a first sub-pixel 110 and a second sub-pixel 120 configured to share one data line $D_m$, a first transistor T1 configured to couple (e.g., connect) the first sub-pixel 110 to the data line $D_m$, and a second transistor T2 configured to couple the second sub-pixel 120 to the data line $D_m$.

The first sub-pixel 110 includes an organic light emitting diode (OLED), a driving transistor $T_d$ including a first electrode coupled (e.g., connected) to a first power source ELVDD and a second electrode coupled to the OLED, a first operation control transistor $T_{gc}$ coupled to a gate electrode (hereinafter referred to as a "first node N1") of the driving transistor $T_d$ and the second electrode of the driving transistor $T_d$, a second operation control transistor $T_{gs}$ coupled to the first electrode of the driving transistor $T_d$ and a second node N2, a storage capacitor $C_{st}$ coupled between the first node N1 and the second node N2, a third operation control transistor $T_{gw}$ coupled between the second node N2 and a third node N3, a hold capacitor $C_{hold}$ coupled between a reference voltage Vref and the third node N3, and a switching transistor $T_s$ coupled between the third node N3 and the first transistor T1.

The second sub-pixel 120 may be configured to mirror the structure of the first sub-pixel 110, symmetrical to each other from a reference point based on the data line $D_m$. Therefore, the second sub-pixel 120 may include a switching transistor $T_s$ between a third node N3 and the second transistor T2. The other components of the second sub-pixel 120 are substantially similar to those described in reference to the first sub-pixel 110, so the description has been omitted for convenience.

A first control signal EnB1 may be applied to the first transistor T1, and a second control signal EnB2 may be applied to the second transistor T2. Further, a scan signal may be applied to the switching transistor $T_s$.

A first operation control signal GC, a second operation control signal GS, and a third operation control signal GW may be applied to the first operation control transistor $T_{gc}$, the second operation control transistor $T_{gs}$, and the third operation control transistor $T_{gw}$, respectively. The plurality of operation control signals GC, GS, GW may be concurrently (e.g., simultaneously) applied to a plurality of first and second sub-pixels 110, 120 included in a display panel.

Figure 5:
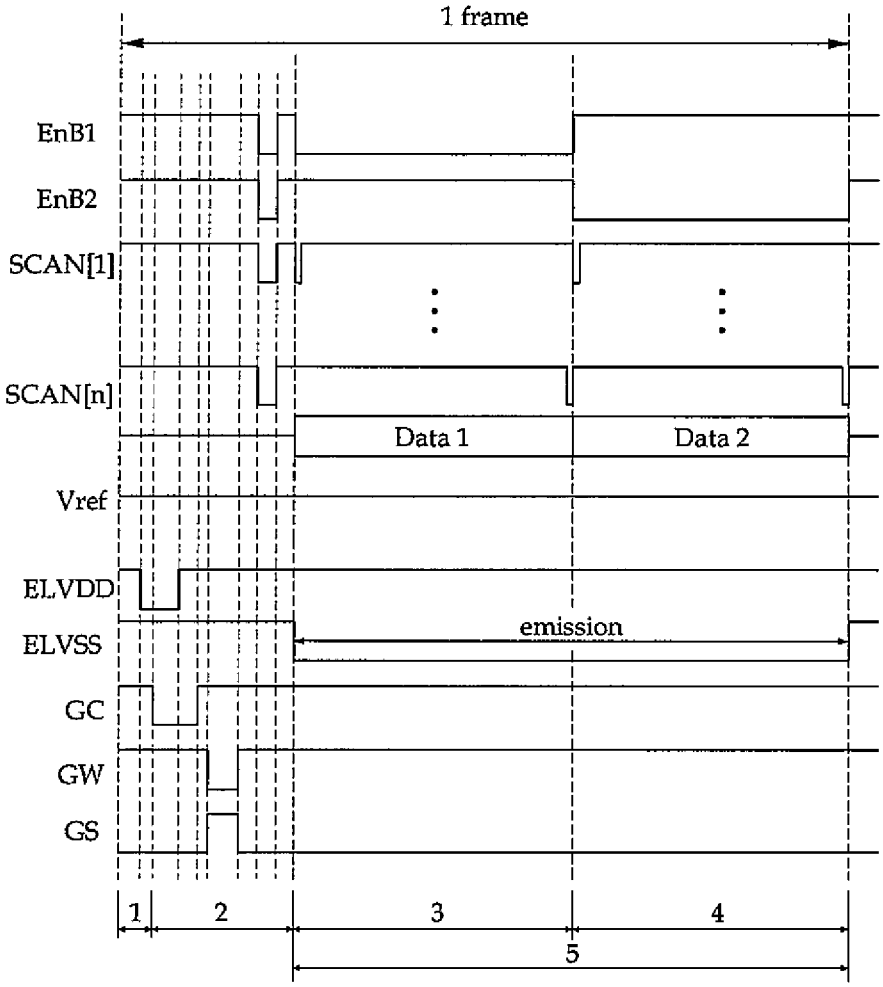
FIG. 5 is a diagram of a driving waveform of the pixel circuit according to the embodiment shown in FIGS. 3 and 4.

FIG. 5 is a diagram of a driving waveform of the pixel circuit according to the embodiment shown in FIGS. 3 and 4.

As illustrated in FIGS. 3 and 5, driving voltages ELVDD and ELVSS, first control signal EnB1, second control signal EnB2, scan signals Scan[1]-Scan[n], first data signal Data1, second data signal Data2, first operation control signal Gc, second operation control signal Gs, and third operation control signal Gw may vary depending on the reset and initialization period 1, compensation and data transmission period 2, first sub-pixel data programming period 3, second sub-pixel data programming period 4, and concurrent (e.g., simultaneous) light emitting period 5 of the first sub-pixel and the second sub-pixel. Hereinafter, the respective transistors will be described as PMOS transistors that are turned on when a low level signal is applied thereto. However, the kind of transistors are not limited thereto.

Referring to FIGS. 3 to 5, the Operations During Each Period Will be Described as Follows.

1. Reset and Initialization Period 1

The second operation control signal GS is applied at a low level value, and thus the second operation control transistor $T_{gs}$ is turned on. A voltage of the first power source ELVDD is applied from a high level value to a low level value, and thus the second node N2 is in a low voltage state. The first node N1 is also in a low voltage state due to the coupling of the storage capacitor $C_{st}$. Thereafter, when the first operation control signal GC is applied (or changed) from a high level value to a low level value, the first operation control transistor $T_{gc}$ is turned on, the driving transistor $T_d$ becomes diode-coupled (e.g., diode-connected), and a voltage of the storage Capacitor $C_{st}$ is reset to a threshold voltage of the driving transistor $T_d$.

2. Compensation and Data Transmission Period 2

When a voltage of the first power source ELVDD is applied (or changed) from a low level value back to a high level value (ELVDD_high), a voltage of the second node N2 becomes a high level value (ELVDD_high). When the voltage of the second node N2 becomes a high level value (EVDD_high), a voltage of the first node N1 becomes ELVDD_high+Vth (Vth: threshold voltage of the driving transistor $T_d$).

Thereafter, the first operation control signal GC is applied (or changed) from a low level value back to a high level value, and thus the first operation control transistor $T_{gs}$ is turned off.

Next, the second operation control signal GS is applied (or changed) from a low level value to a high level value, and concurrently (e.g., simultaneously) the third operation control signal GW is applied (or changed) from a high level value to a low level value. Thus, the second operation control transistor $T_{gs}$ is turned off, and the third operation control transistor $T_{gw}$ is turned on.

Accordingly, the storage capacitor $C_{st}$ and the hold capacitor $C_{hold}$ become electrically coupled (e.g., electrically connected) in series.

A data value of a previous frame (e.g., Vref-Data1 or Vref-Data2), is stored in the hold capacitor $C_{hold}$. The data value of a previous frame is transferred to the storage capacitor $C_{st}$, and supplies the data for emission during a present frame period.

Next, the third operation control signal GW is applied (or changed) from a low level value to a high level value, and concurrently (e.g., simultaneously), the second operation control signal GS is applied (or changed) from a high level value to a low level value. Thus, the third operation control transistor $T_{gw}$ is turned off, and the second operation control transistor $T_{gs}$ is turned on.

Next, when the scan signals Scan[1]-Scan[n], the first control signal EnB1, and the second control signal EnB2 are applied (or changed) from a high level value to a low level value, the switching transistor $T_s$, the first transistor T1, and the second transistor T2 are turned on. Also, a data value of a previous frame stored in the hold capacitor $C_{hold}$ is initialized.

3. First Sub-Pixel Data Programming Period 3

While the first control signal EnB1 is applied at a low level value, and the first transistor T1 is turned on, and while the second control signal EnB2 is applied at a high level value, and the second transistor T2 is turned off, the scan signals Scan[1]-Scan[n] are sequentially applied (or changed) from a high level value to a low level value. When the scan signals are sequentially applied (or changed), the switching transistors $T_s$ are sequentially turned on, and data to be displayed during an emission period of a next frame is sequentially programmed in the hold capacitor $C_{hold}$ of the first sub-pixel. In this case, the data programmed in the hold capacitor $C_{hold}$ of the first sub-pixel is Vref-Data1.

4. Second Sub-Pixel Data Programming Period 4

While the first control signal EnB1 is applied at a high level value, and the first transistor T1 is turned off, and while the second control signal EnB2 is applied at a low level value, and the second transistor T2 is turned on, the scan signals Scan [1]-Scan[n] are sequentially applied (or changed) from a high level value to a low level value. When the scan signals are sequentially applied (or changed), the switching transistors $T_s$ are sequentially turned on, and data to be displayed during an emission period of a next frame is sequentially programmed in the hold capacitor $C_{hold}$ of the second sub-pixel. In this case, the data programmed in the hold capacitor $C_{hold}$ of the second sub-pixel is Vref-Data2.

5. Concurrent (e.g., Simultaneous) Light Emitting Period of the First Sub-Pixel and the Second Sub-Pixel 5

When the second power source ELVSS is supplied at a low voltage value, current flows to the organic light emitting diode (OLED) so the first sub-pixel 110 and the second sub-pixel 120 concurrently (e.g., simultaneously) emits light. The data Programming periods 3 and 4 of the first sub-pixel and the second sub-pixel, respectively, may have a temporal overlap with the concurrent light emitting period 5 of the first sub-pixel and the second sub-pixel.

Figure 6:
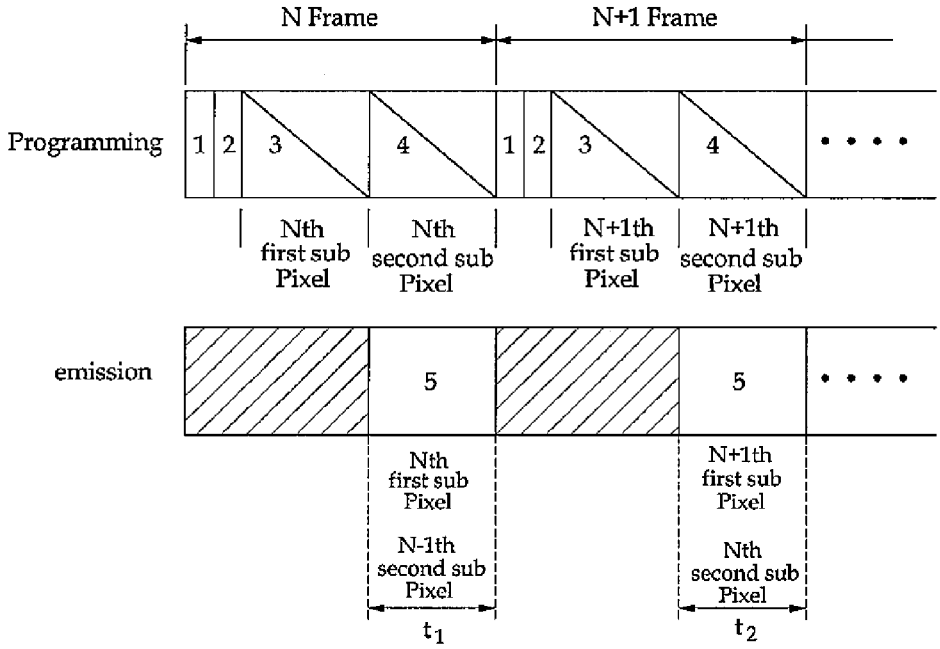
FIG. 6 is a diagram of a driving method of a pixel circuit according to another embodiment of the present invention.

FIG. 6 is a diagram of a driving method of a pixel circuit according to another embodiment of the present invention.

Referring to FIG. 6, one frame period includes a reset and initialization period 1, a compensation and data transmission period 2, a data programming period 3 of the first sub-pixel 110', a data programming period 4 of the second sub-pixel 120, and a concurrent (e.g., simultaneous) light emitting period 5 of the first sub-pixel 110' and the second sub-pixel 120. The data programming period 4 of the second sub-pixel 120 may have a temporal overlap with the concurrent light emitting period 5 of the first sub-pixel 110' and the second sub-pixel 120.

In detail, during an Nth frame, the first sub-pixel 110' and the second sub-pixel 120 emit light concurrently (e.g., simultaneously) according to data programmed during the data programming period 3 of the first sub-pixel 110' during the Nth frame and data programmed during the data programming period 4 of the second sub-pixel 120 during the N−1th frame. Further, during an N+1th frame, the first sub-pixel 110' and the second sub-pixel 120 emit light concurrently (e.g., simultaneously) according to data programmed during the data programming period 3 of the first sub-pixel 110' during the N+1th frame and data programmed during the data programming period 4 of the second sub-pixel 120 during the Nth frame.

For example, a period $t_1$ includes the data programming period 4 of the second sub-pixel 120 during the Nth frame, and the concurrent (e.g., simultaneous) light emitting period 5 of the first sub-pixel 110', which emits light according to the data programmed during the Nth frame, and the second sub-pixel 120, which emits light according to the data programmed during the N−1th frame.

A period $t_2$ includes the data programming period 4 of the second sub-pixel 120 during the N+1th frame, and the concurrent light emitting period 5 of the first sub-pixel 110', which emits light according to the data programmed during the N+1th frame, and the second sub-pixel 120, which emits light according to the data programmed during the Nth frame.

Figure 7:
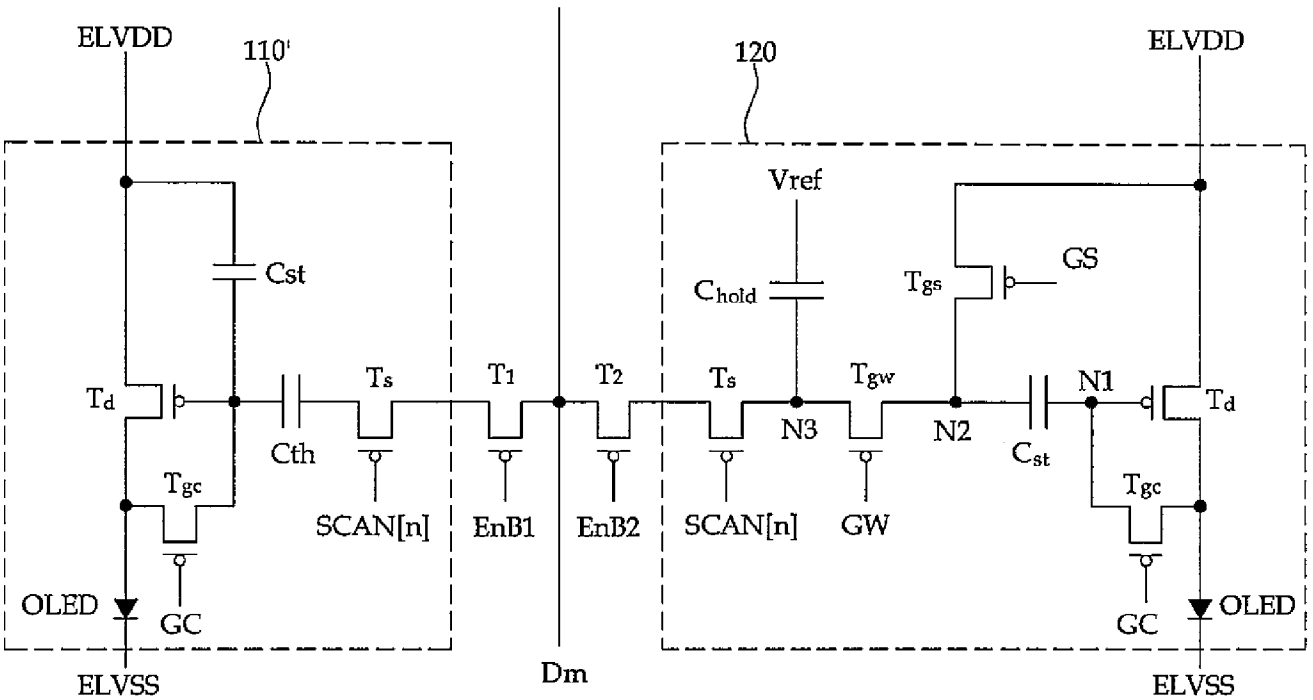
FIG. 7 is a diagram of a pixel circuit that may be driven according to the driving method of FIG. 6.

FIG. 7 is a diagram of a pixel circuit that may be driven according to the driving method of FIG. 6.

Referring to FIG. 7, a pixel circuit may include a first sub-pixel 110' and a second sub-pixel 120 configured to share one data line $D_m$. A first transistor T1 may be configured to couple (e.g., connect) the first sub-pixel 110' to the data line $D_m$. A second transistor T2 may be configured to couple the second sub-pixel 120 to the data line $D_m$.

The first sub-pixel 110' may include an organic light emitting diode (OLED), a driving transistor $T_d$ including a first electrode coupled (e.g., connected) to a first power source ELVDD and a second electrode coupled to the OLED, a threshold voltage compensation capacitor $C_{th}$ coupled to a gate electrode of the driving transistor $T_d$, a switching transistor $T_s$ coupled between the threshold voltage compensation capacitor $C_{th}$ and the first transistor T1, a storage capacitor $C_{st}$ coupled between the gate electrode of the driving transistor $T_d$ and the first electrode of the driving transistor $T_d$, and a first operation control transistor $T_{gc}$ coupled between the gate electrode of the driving transistor $T_d$ and the second electrode of the driving transistor $T_d$.

The second sub-pixel 120 may include an organic light emitting diode (OLED), a driving transistor $T_d$ including a first electrode coupled (e.g., connected) to a first power source ELVDD and a second electrode coupled to the OLED, a first operation control transistor $T_{gc}$ coupled to a gate electrode (hereinafter referred to as a "first node N1") of the driving transistor $T_d$ and the second electrode of the driving transistor $T_d$, a second operation control transistor $T_{gs}$ coupled to the first electrode of the driving transistor $T_d$ and a second node N2, a storage capacitor $C_{st}$ coupled between the first node N1 and the second node N2, a third operation control transistor $T_{gw}$ coupled between the second node N2 and a third node N3, a hold capacitor $C_{hold}$ coupled between a reference voltage Vref and the third node N3, and a switching transistor $T_s$ coupled between the third node N3 and the second transistor T2.

According to an embodiment of the present invention, the first sub-pixel 110' and second sub-pixel 120 may be configured to be asymmetric to each other. In this embodiment, the first sub-pixel 110' may have a smaller number of transistors than the second sub-pixel 120, and the first sub-pixel 110' may not have a Vref wire (as compared to the second sub-pixel 120). Thus, this embodiment may have advantages of increasing an aperture ratio and decreasing defects caused in process.

The first sub-pixel circuit 110' according to an embodiment of the present invention may be configured to reduce the number of transistors. However, this is not limited thereto, and the second sub-pixel 120 may be configured to reduce the number of transistors.

Further, a plurality of first sub-pixels 110' and a plurality of second sub-pixels 120, which are provided in a display panel, may be alternately configured to reduce the number of transistors.

A first control signal EnB1 may be applied to the first transistor T1, and a second control signal EnB2 may be applied to the second transistor T2. Further, a scan signal may be applied to the switching transistor $T_s$.

A first operation control signal GC, a second operation control signal GS, and a third operation control signal GW may be applied to the first operation control transistor $T_{gc}$, the second operation control transistor $T_{gs}$, and the third operation control transistor $T_{gw}$, respectively. The plurality of operation control signals GC, GS, GW may be concurrently (e.g., simultaneously) applied to the plurality of first and second sub-pixels 110' and 120, respectively, included in a display panel.

Figure 8:
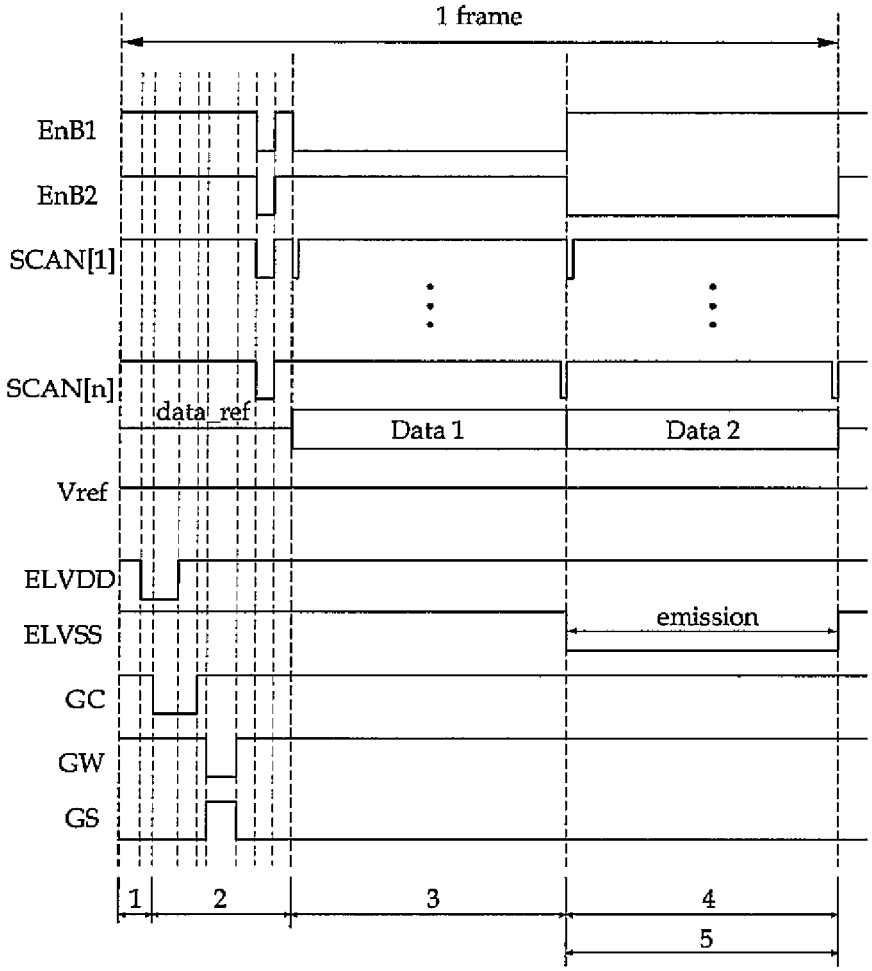
FIG. 8 is a diagram of a driving waveform of the pixel circuit according to the embodiment shown in FIGS. 6 and 7.

FIG. 8 is a diagram of a driving waveform of the pixel circuit according to the embodiment shown in FIGS. 6 and 7.

As illustrated in FIGS. 6 and 8, driving voltages ELVDD and ELVSS, first control signal EnB1, second control signal EnB2, scan signals Scan[1] Scan[n], first data signal Data1, second data signal Data2, first operation control signal GC, second operation control signal GS, and third operation control signal GW may vary depending on the reset and initialization period 1, compensation and data transmission period 2, first sub-pixel data programming period 3, second sub-pixel data programming period 4, and concurrent (e.g., simultaneous) light emitting period 5 of the first sub-pixel and the second sub-pixel. Hereinafter, the respective transistors will be described as PMOS transistors that are turned on when a low level signal is applied thereto. However, the kind of transistors are not limited thereto.

Referring to FIGS. 6 to 8, operations of the pixel circuit during each period will be described as follows. The operations of the pixel circuit during the reset and initialization period 1, and the compensation and data transmission period 2 with respect to the second sub-pixel 120 are substantially similar to those described in relation to FIGS. 3-5 of the present invention above, and thus the description thereof will be omitted.

1. Reset and Initialization Period 1 of the First Sub-Pixel

A voltage of the first power source ELVDD is supplied (or changed) from a high level value to a low level value. The gate electrode of the driving transistor $T_d$ is in a low level voltage state due to the coupling of the storage capacitor $C_{st}$. Thereafter, when the first operation control signal GC is applied (or changed) from a high level value to a low level value, the first operation control transistor $T_{gc}$ is turned on. When the first operation control transistor $T_{gc}$ is turned on, the driving transistor $T_d$ becomes diode-coupled (e.g., diode-connected), and a voltage of the storage capacitor $C_{st}$ is reset to a threshold voltage of the driving transistor $T_d$.

2. Compensation and Data Transmission Period 2 of the First Sub-Pixel

When a voltage of the first power source ELVDD is supplied (or changed) from a low level value back to a high level value (ELVDD_high), a voltage applied to the gate electrode of the driving transistor $T_d$ is ELVDD_high+Vth (Vth: threshold voltage of the driving transistor $T_d$). Thereafter, the first control signal EnB1 is applied (or changed) from a high level value to a low level value, and thus the first transistor T1 is turned on. Concurrently (e.g., simultaneously) the scan signals SCAN[1]-SCAN[n] are applied (or changed) from a high level value to a low level value, and thus the switching transistor $T_s$ is turned on. Accordingly, a voltage of ELVDD_high+Vth-data_ref is stored in the threshold voltage compensation capacitor $C_{th}$. In other words, when a voltage of data_ref is substantially similar to ELVDD_high, a Vth voltage is applied to the threshold voltage compensation capacitor $C_{th}$.

3. First Sub-Pixel Data Programming Period 3

While the first control signal EnB1 is applied at a low level value, and the first transistor T1 is turned on, and while the second control signal EnB2 is applied at a high level value, and the second transistor T2 is turned off, the scan signals Scan[1]-Scan[n] are sequentially applied (or changed) from a high level value to a low level value. Thus, the switching transistors $T_s$ are sequentially turned on, and data to be displayed during an emission period of a present frame is sequentially programmed in the storage capacitor $C_{st}$ and the threshold voltage compensation capacitor $C_{th}$ of the first sub-pixel.

4. Second Sub-Pixel Data Programming Period 4

While the first control signal EnB1 is applied at a high level value, and the first transistor T1 is turned off, and while the second control signal EnB2 is applied at a low level value, and the second transistor T2 is turned on, the scan signals Scan[1]-Scan[n] are sequentially applied (or changed) from a high level value to a low level value. Thus, the switching transistors $T_s$ are sequentially turned on, and data to be displayed during an emission period of a next frame is sequentially programmed in the hold capacitor $C_{hold}$ of the second sub-pixel.

5. Concurrent (e.g., Simultaneous) Light Emitting Period of the First Sub-Pixel and the Second Sub-Pixel 5

When the second power source ELVSS is supplied at a low voltage value, current flows to the organic light emitting diode (OLED), and the first sub-pixel 110' and the second sub-pixel 120 are concurrently (e.g., simultaneously) emitted The data programming period 4 of the second sub-pixel may have a temporal overlap with the concurrent light emitting period 5 of the first sub-pixel and the second sub-pixel.

From the foregoing, it will be appreciated by those skilled in the art that various embodiments of the present invention have been described herein for purposes of illustration, and that various modifications may be made without departing from the scope and spirit of the present disclosure. Accordingly, the various embodiments disclosed herein are not intended to be limiting, and the true scope and spirit of the present invention is defined by the appended claims, and equivalents thereof.

What is claimed is:

1. A display device comprising:

a first sub-pixel and a second sub-pixel configured to share one data line;

a first transistor configured to turn on or off by a first control signal and configured to couple the first sub-pixel to the one data line; and a second transistor configured to turn on or off alternately with the first transistor by a second control signal having a phase difference from the first control signal and configured to couple the second sub-pixel to the one data line.

2. The display device of claim 1, wherein the first control signal and the second control signal each have a high level and a low level, respectively, during one frame period.

3. The display device of claim 1, wherein the first control signal has a 180 degree phase difference from the second control signal.

4. The display device of claim 1, wherein the first sub-pixel is configured to receive a data signal supplied from the one data line when the first transistor is turned on, and the second sub-pixel is configured to receive a data signal supplied from the one data line when the second transistor is turned on.

5. The display device of claim 1, wherein the first sub-pixel and the second sub-pixel are configured to emit light concurrently with luminance according to a data signal of an N−1th frame when the first sub-pixel and the second sub-pixel are supplied with a data signal according to an Nth frame.

6. The display device of claim 1, wherein the first sub-pixel is configured to emit light with luminance according to a data signal of an Nth frame, and the second sub-pixel is configured to emit light with luminance according to a data signal of an N−1th frame, when a data signal according to an Nth frame is applied to either the first sub-pixel or the second sub-pixel.

7. The display device of claim 5, wherein the first sub-pixel and the second sub-pixel each comprise:

an organic light emitting diode, a driving transistor comprising a first electrode coupled to a first power source and a second electrode coupled to the organic light emitting diode, a first operation control transistor coupled to a gate electrode of the driving transistor at a first node and the second electrode of the driving transistor, a second operation control transistor coupled to the first electrode of the driving transistor and a second node, a storage capacitor coupled between the first node and the second node, a third operation control transistor coupled between the second node and a third node, a hold capacitor coupled between a reference voltage and the third node, and a switching transistor, wherein the switching transistor of the first sub-pixel is coupled between the third node of the first sub-pixel and the first transistor, and the switching transistor of the second sub-pixel is coupled between the third node of the second sub-pixel and the second transistor.

8. The display device of claim 7, wherein the hold capacitor is configured to reset a data of a previous frame stored in the hold capacitor when the first transistor, the second transistor, and the switching transistor are turned on.

9. The display device of claim 6, wherein the first sub-pixel comprises:

an organic light emitting diode, a driving transistor comprising a first electrode coupled to a first power source ELVDD and a second electrode coupled to the organic light emitting diode, a threshold voltage compensation capacitor coupled to a gate electrode of the driving transistor, a switching transistor coupled between the threshold voltage compensation capacitor and the first transistor, a storage capacitor coupled between the gate electrode of the driving transistor and the first electrode of the driving transistor, and a first operation control transistor coupled between the gate electrode of the driving transistor and the second electrode of the driving transistor.

10. The display device of claim 9, wherein the storage capacitor is configured to reset a data of a previous frame stored in the storage capacitor when the first transistor and the switching transistor are turned on.

11. The display device of claim 9, wherein the second sub-pixel comprises:

an organic light emitting diode, a driving transistor comprising a first electrode coupled to a first power source and a second electrode coupled to the organic light emitting diode, a first operation control transistor coupled to a gate electrode of the driving transistor at a first node and the second electrode of the driving transistor, a second operation control transistor coupled to the first electrode of the driving transistor and a second node, a storage capacitor coupled between the first node and the second node, a third operation control transistor coupled between the second node and a third node, a hold capacitor coupled between a reference voltage and the third node, and a switching transistor coupled between the third node and the second transistor.

12. The display device of claim 11, wherein the hold capacitor is configured to reset a data of a previous frame stored in the hold capacitor when the second transistor and the switching transistor are turned on.

13. A method of driving a display device comprising a first sub-pixel and a second sub-pixel configured to share one data line, a first transistor and a second transistor configured to couple the one data line to the first sub-pixel and the second sub-pixel, respectively, the method comprising:

applying a first control signal to turn on the first transistor;

first scanning, wherein a data signal is applied to the first sub-pixel through the turned on first transistor, and the applied data signal is stored in the first sub-pixel;

applying a second control signal to turn on the second transistor;

second scanning, wherein a data signal is applied to the second sub-pixel through the turned on second transistor, and the applied data signal is stored in the second sub-pixel; and emitting light from the first sub-pixel and the second sub-pixel, wherein the emitting light from the first sub-pixel and the second sub-pixel has a temporal overlap with the first scanning and the second scanning.

14. The method of driving the display device of claim 13, wherein the first sub-pixel and the second sub-pixel emit light concurrently with luminance according to a data signal of an N−1th frame, when a data signal according to an Nth frame is applied to the first sub-pixel and the second sub-pixel.

15. A method of driving a display device comprising a first sub-pixel and a second sub-pixel configured to share one data line, a first transistor and a second transistor configured to couple the one data line to the first sub-pixel and the second sub-pixel, respectively, the method comprising:

applying a first control signal to turn on the first transistor;

first scanning, wherein a data signal is applied to the first sub-pixel through the turned on first transistor, and the applied data signal is stored in the first sub-pixel;

applying a second control signal to turn on the second transistor;

second scanning, wherein a data signal is applied to the second sub-pixel through the turned on second transistor, and the applied data signal is stored in the second sub-pixel; and emitting light from the first sub-pixel and the second sub-pixel, wherein the emitting light from the first sub-pixel and the second sub-pixel has a temporal overlap with any one selected from the first scanning and the second scanning.

16. The method of driving the display device of claim 15, wherein the first sub-pixel emits light with luminance according to a data signal of an Nth frame, and the second sub-pixel emits light with luminance according to a data signal of an N−1th frame, when a data signal of an Nth frame is applied to any one of the first sub-pixel and the second sub-pixel.

* * * * *